US006317889B1

(12) United States Patent
Reilly et al.

(10) Patent No.: US 6,317,889 B1
(45) Date of Patent: Nov. 20, 2001

(54) PROTECTIVE PAD FOR PROTECTIVE GARMENT

(75) Inventors: John Reilly, Rockville Centre, NY (US); William L. Grilliot; Mary I. Grilliot, both of Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 09/666,193

(22) Filed: Sep. 21, 2000

(51) Int. Cl.[7] ..... A41D 13/00
(52) U.S. Cl. ..... 2/24; 2/62; 2/81
(58) Field of Search ..... 2/62, 455, 458, 2/16, 22, 23, 24, 267, 268, 247, 227, 79, 81, 97, 164, 167, 908, 911, 2.5, 411

(56) References Cited

U.S. PATENT DOCUMENTS

| | | | | |
|---|---|---|---|---|
| 2,855,758 | | 11/1958 | Johnson . | |
| 3,429,138 | | 2/1969 | Goldmerstein . | |
| 3,670,731 | | 6/1972 | Harmon . | |
| 3,971,373 | | 7/1976 | Braun . | |
| 4,105,033 | | 8/1978 | Chatterjee et al. . | |
| 4,133,055 | | 1/1979 | Zebuhr . | |
| 4,235,237 | | 11/1980 | Mesek et al. . | |
| 4,429,001 | | 1/1984 | Kolpin et al. . | |
| 4,433,024 | | 2/1984 | Eian . | |
| 4,530,873 | | 7/1985 | Okada . | |
| 4,556,055 | | 12/1985 | Bonner, Jr. . | |
| 4,985,298 | | 1/1991 | Buckley et al. . | |
| 5,050,244 | * | 9/1991 | Kleinman | 2/227 |
| 5,087,513 | | 2/1992 | Kim . | |
| 5,105,473 | * | 4/1992 | Valtakari | 2/456 |
| 5,113,666 | | 5/1992 | Parrish et al. . | |
| 5,224,221 | | 7/1993 | Richardson et al. . | |
| 5,289,695 | | 3/1994 | Parrish et al. . | |
| 5,328,759 | | 7/1994 | McCormack et al. . | |
| 5,419,955 | | 5/1995 | Ehrhardt et al. . | |

(List continued on next page.)

*Primary Examiner*—John J. Calvert
*Assistant Examiner*—Tejash D Patel
(74) *Attorney, Agent, or Firm*—Rockey, Milnamow & Katz, Ltd.

(57) ABSTRACT

A protective pad is affixed to a protective garment having a moisture barrier and having an outer shell covering the moisture barrier, the moisture barrier being impervious to moisture and the outer shell being pervious to moisture. The protective pad has a moisture absorber incorporating a superabsorbent polymer and an outer cover pervious to moisture. The moisture absorber covers a region of the outer shell of the protective garment. The outer cover of the protective pad covers the moisture barrier. The outer cover of the protective pad is affixed to the outer cover of the protective garment, at least partly around the moisture absorber. The outer cover of the protective pad and the outer shell of the protective garment, in the covered region, are adapted to conduct moisture into the moisture absorber, in which the superabsorbent polymer is adapted to absorb much if not all moisture conducted into the moisture absorber. The moisture absorber has a fibrous matrix incorporating particles of the superabsorbent polymer and being disposed between an inner cover pervious to moisture and an outer cover pervious to moisture. The covers may be quilted so as to segregate discrete regions of the fibrous matrix. The outer cover of the protective pad is affixed to the outer shell of the protective garment, at least partly around the moisture absorber, as by stitching or adhesively. A gap may be left, which enables the moisture absorber to be withdrawn from a space between the outer cover of the protective pad and the outer cover of the protective garment, to be reinserted into the space therebetween, or to be replaced by a similar absorber to be inserted into the space therebetween. A fastener may be provided to fasten the outer cover of the protective pad releasably to the outer shell, across the gap.

7 Claims, 1 Drawing Sheet

U.S. PATENT DOCUMENTS

| | | | |
|---|---|---|---|
| 5,483,697 | 1/1996 | Fuchs . | |
| 5,486,410 | 1/1996 | Groeger et al. . | |
| 5,524,294 | 6/1996 | Richardson et al. . | |
| 5,572,745 | 11/1996 | Mainus . | |
| 5,597,647 | 1/1997 | Powers . | |
| 5,630,230 | 5/1997 | Fujino et al. . | |
| 5,817,365 | 10/1998 | Richardson et al. . | |
| 5,885,912 | 3/1999 | Bumbarger . | |
| 5,887,276 | 3/1999 | Lee . | |
| 5,896,583 * | 4/1999 | Grilliot et al. | 2/81 |
| 5,956,759 | 9/1999 | Benedict . | |

* cited by examiner

FIG. 1
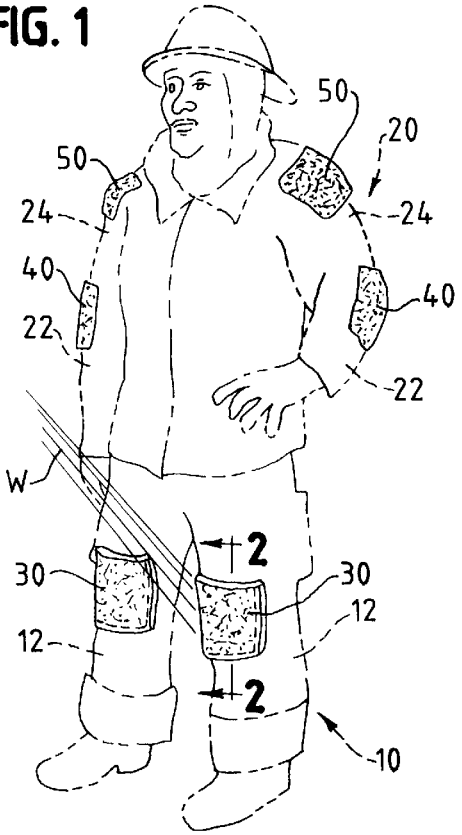
FIG. 2
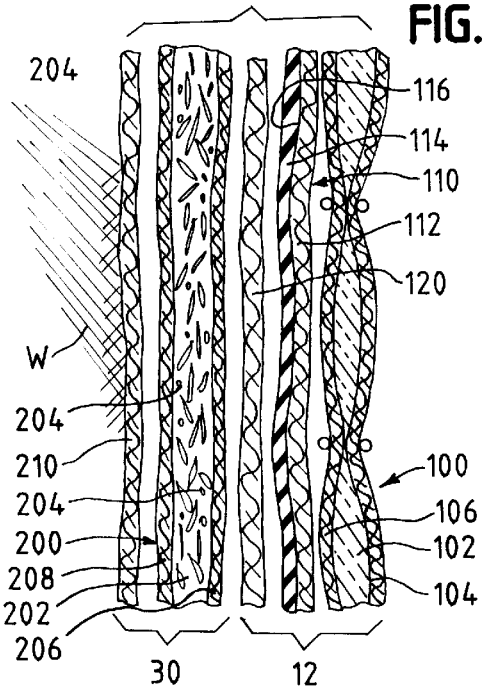
FIG. 3
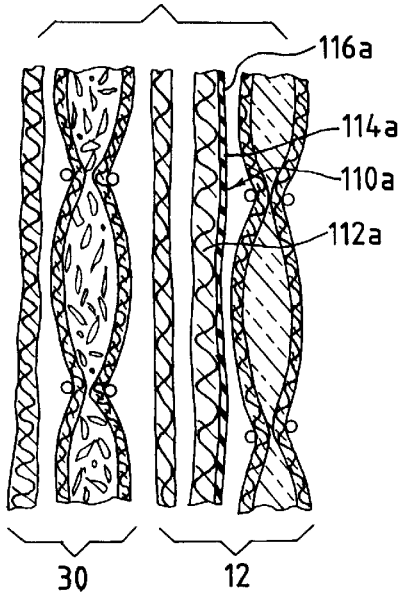
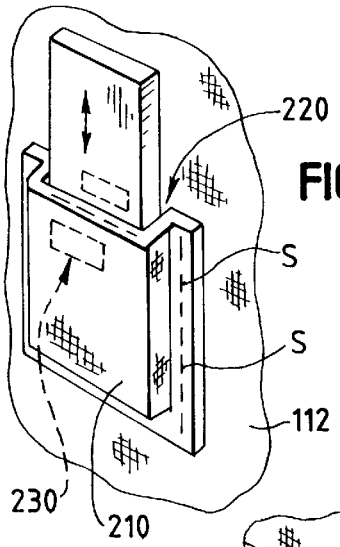
FIG. 4
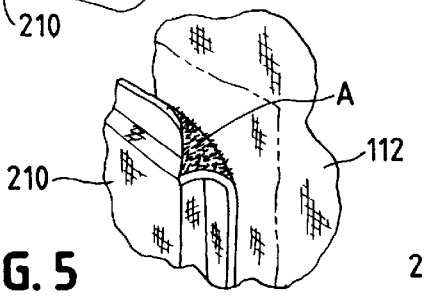
FIG. 5
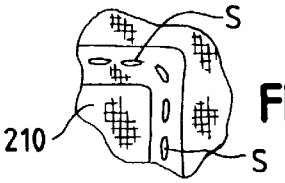
FIG. 6

PROTECTIVE PAD FOR PROTECTIVE GARMENT

TECHNICAL FIELD OF THE INVENTION

This invention pertains to a protective pad, such as a knee pad, an elbow pad, or a shoulder pad, which is affixable to a protective garment, such as a pair of bunker pants for a firefighter or a bunker coat for a firefighter. This invention contemplates that the protective pad incorporates a superabsorbent polymer.

BACKGROUND OF THE INVENTION

Commonly, a protective garment, such as a pair of bunker pants for a firefighter or a bunker coat for a firefighter, has a composite structure, which is made from fire-resistant materials and which has a thermal barrier, a moisture barrier covering the thermal barrier and being impervious to moisture, and an outer shell covering the moisture barrier, providing puncture resistance, abrasion resistance, or both, and being pervious to moisture.

Commonly, a protective pad, such as a knee pad, an elbow pad, or a shoulder pad, is affixed to such a garment. Commonly, as known heretofore, such a protective pad is made from fire-resistant materials and has a thermal barrier and an outer cover covering the thermal barrier and providing puncture resistance, abrasion resistance, or both.

Usage of particles of a superabsorbent polymer in a composite structure for a protective garment, such as a protective garment for a firefighter, is disclosed in U.S. Pat. No. 5,885,912 to Bumberger, the disclosure of which is incorporated herein by reference.

Hereinbefore and hereinafter, moisture refers to any predominantly aqueous liquid, particularly but not exclusively water. Hereinbefore and hereinafter, terms such as inner and outer are employed from a standpoint of a wearer of a protective garment.

SUMMARY OF THE INVENTION

This invention further contemplates that, when the protective pad is affixed to the protective garment, the moisture absorber covers a region of the outer shell of the protective garment, the outer cover of the protective pad covers the moisture absorber, the outer cover of the protective pad is affixed to the outer cover of the protective garment, at least partly around the moisture absorber, and the outer cover of the protective pad and the outer shell of the protective garment, in the covered region, are adapted to conduct moisture into the moisture absorber, in which the superabsorbent polymer is adapted to absorb much if not all moisture conducted into the moisture absorber.

This invention contemplates that the protective pad has a moisture absorber, which is pervious to moisture and which incorporates a superabsorbent polymer, and that the protective pad has an outer cover, which is pervious to moisture. The superabsorbent polymer may be a cross-linked polyacrylamide.

This invention further contemplates that, when the protective pad is affixed to the protective garment, the moisture absorber covers a region of the outer shell of the protective garment, the outer cover of the protective pad covers the moisture barrier, the outer cover of the protective pad is affixed to the outer cover of the protective garment, at least partly around the moisture absorber, and the outer cover of the protective pad and the outer shell of the protective garment, in the covered region, are adapted to conduct moisture into the moisture absorber, in which the superabsorbent polymer is adapted to absorb much if not all moisture conducted into the moisture absorber.

In a firefighting environment, the protective garment and the protective pad are deluged frequently by water from fire hoses. Moisture, such as water from fire hoses, is absorbed by the moisture absorber, particularly but not exclusively by the superabsorbent polymer, so as to provide a heat-absorbing mass, which enhances thermal protection at the covered region. By judicious placements of protective knee, elbow, and shoulder pads embodying this invention, thermal protection can be enhanced greatly at knees, elbows, and shoulders, which tend to be particularly susceptible to thermal challanges.

Preferably, the moisture absorber has a fibrous matrix incorporating the superabsorbent polymer, as particles in a preferred embodiment. In the preferred embodiment, the fibrous matrix is disposed between an inner cover pervious to moisture and an outer cover pervious to moisture and the inner and outer covers, between which the fibrous matrix is disposed, are quilted so as to segregate discrete regions of the fibrous matrix. Alternatively, the fibrous matrix incorporates fibers of the superabsorbent polymer, rather than particles of the superabsorbent polymer.

Preferably, the outer cover of the protective pad is affixed to the outer shell of is the protective garment, at least partly around the moisture absorber, as by stitching or adhesively. Alternatively, non-metallic fasteners, such as zippers, snap fasteners, or hook-and-loop fasteners, can be used to affix the outer cover of the protective pad to the outer shell of the protective garment. Metallic fasteners, which tend to be heat-conductive, are not favored to affix the outer cover of the protective pad to the outer shell of the protective garment.

Preferably, the outer cover of the protective pad is affixed to the outer shell of the protective garment, at least partly around the moisture absorber, except for a gap enabling the moisture absorber to be withdrawn from a space between the outer cover of the protective pad and the outer cover of the protective garment, to be reinserted into the space therebetween, or to be replaced by a similar absorber to be inserted into the space therebetween. If the superabsorbent polymer is not susceptible to drying for reuse, it is preferable to provide such a gap so as to enable the moisture absorber to be withdrawn, after the moisture absorber has been saturated, and to be replaced.

If such a gap is provided, a non-metallic fastener, such as a hook-and-loop fastener, may be used to fasten the outer cover of the protective pad releasably to the outer shell of the protective garment, across the gap. A metallic fastener, which tends to be heat-conductive is not favored to fasten the outer cover of the protective pad releasably to the outer shell of the protective garment, across the gap.

BRIEF DESCRIPTION OF THE DRAWINGS

FIG. 1 is a pictorial view of a firefighter wearing two protective garments, to which six protective pads embodying this invention have been affixed, namely a pair of bunker pants, to which two knee pads have been affixed, and a bunker coat, to which two elbow pads and two shoulder pads have been affixed. The firefighter and the protective garment are shown in broken lines.

FIG. 2, on a larger scale compared to FIG. 1, is a sectional view taken along line 2—2 in FIG. 1, in a direction indicated by arrows, and showing a contemplated embodiment of this invention.

FIG. 3, on a similar scale, is a similar, sectional view showing an alternative embodiment of this invention.

FIGS. 4, 5, and 6, on an intermediate scale, are fragmentary, perspective views showing alternative ways to affix a protective pad embodying this invention to a protective garment.

DETAILED DESCRIPTION OF THE ILLUSTRATED EMBODIMENTS

As shown in FIG. 1, a firefighter is wearing two protective garments, to which six protective pads embodying this invention are affixed, namely a pair of bunker pants 10 and a bunker coat 20. Two knee pads 30 embodying this invention are affixed to the pair of bunker pants 10, one knee pad 30 being affixed to each leg 12 of the pair of bunker pants 10. Two elbow pads 40 embodying this invention are affixed to the bunker coat 20, one elbow pad 40 being affixed to each arm 22 of the bunker coat 20. Two shoulder pads 50 embodying this invention are affixed to the bunker coat 20, one shoulder pad 50 being affixed to each shoulder 24 of the bunker coat 20. Except for where the respective pads 30, 40, 50 are affixed, the respective pads 30, 40, 50 are similar to one another and may be affixed similarly. As shown in FIG. 2, as a representative example of the respective pads 30, 40, 50, one knee pad 30 is illustrated in further detail.

As shown in FIG. 2, the pants leg 12, to which the knee pad 30 is affixed has a composite structure, which is made from fire-resistant materials and which has a thermal barrier 100, a moisture barrier 110 covering the thermal barrier 100 and being impervious to moisture, and an outer shell 120 covering the moisture barrier 110, providing puncture resistance, abrasion resistance, or both, and being pervious to moisture. The thermal barrier 100, which is conventional, has a fibrous matrix 102, which is disposed between an inner cover 104 and an outer cover 106. The covers 104, 106, which may be woven or non-woven, are quilted so as to segregate discrete regions of the fibrous matrix 102.

As shown in FIG. 2, the moisture barrier 110, which is conventional, has a textile layer 112 and a moisture-impervious layer 114, e.g. a neoprene layer, which is laminated onto the outer surface 116 of the textile layer 112. The outer shell 120, which is conventional, is woven from fibers, e.g Kevlar™ fibers, which provide puncture resistance and abrasion resistance.

In an alternative construction, which is shown in FIG. 3, a moisture barrier 110*a* is substituted for the moisture barrier 110. The moisture barrier 110*a*, which is conventional, has a textile layer 112*a* and a moisture-impervious layer 114*a*, e.g. a Breathe Tex™ layer, which is coated onto the inner surface 116*a* of the textile layer 112*a*. In other alternative constructions, which are not shown, a moisture-impervious layer, e.g. a neoprene layer, is laminated to the inner surface of the outer shell or a moisture-impervious layer, e.g. a Breathe Tex™ layer, is coated on the inner surface of the outer shell.

As shown in FIG. 2, the knee pad 30 has a moisture absorber 200, which is pervious to moisture and which has a fibrous matrix 202 incorporating particles 204 of a superabsorbent polymer, such as a cross-inked polyacrylamide. The fibrous matrix is disposed between an inner cover 206 pervious to moisture and an outer cover 208 pervious to moisture.

Examples of superabsorbent polymers and processes for their incorporation into fibrous matrices are disclosed in prior patents including U.S. Pat. No. 3,670,731 to Harmon, U.S. Pat. No. 4,105,033 to Chaterjee et al, U.S. Pat. No. 4,235,237 to Mesek et al., U.S. Pat. No. 4,429,001 to Kolpin et al., U.S. Pat. No. 4,985,298 to Buckley et al., U.S. Pat. No. 5,087,513 to Kim, U.S. Pat. No. 5,328,759 to McCormack et al., and U.S. Pat. No. 5,419,955 to Ehrhardt et al., the disclosures of which are incorporated herein by reference.

As shown in FIG. 2, the knee pad 30 has an outer cover 210, which is similar to the outer shell 120 of the pants leg 12. Thus, the outer cover 210 is woven from fibers, e.g. Kevlar™ fibers, which provide puncture resistance and abrasion resistance.

As shown in FIG. 2, the covers 206, 208 of the moisture absorber 200 of the knee pad 30 are not quilted. In the alternative construction shown in FIG. 3, the covers 206, 208 of the moisture absorber 200 of the knee pad 30 are quilted so as to segregate discrete regions of the fibrous matrix 202 incorporating particles 204 of the superabsorbent polymer.

The knee pad 30 is affixed to the protective garment so that the moisture absorber 200 covers a region of the outer shell 112 of the pants leg 12, so that the outer cover 210 of the knee pad 30 covers the moisture absorber 200, and so that the outer cover 210 of the knee pad 30 is affixed to the outer shell 112 of the pants leg 12, at least partly around the moisture absorber 200. Being pervious to moisture, the outer cover 210 of the knee pad 30 and the outer shell 112 of the pants leg 12, in the covered region, are adapted to conduct moisture into the moisture absorber 200, in which the superabsorbent polymer is adapted to absorb much if not all moisture conducted into the moisture absorber 200.

Commonly, in a firefighting environment, the pants leg 12 and the knee pad 30 are deluged frequently by water from fire hoses. Moisture, such as water W from a fire hose (not shown) or from another source, is absorbed by the moisture absorber 200, particularly but not exclusively by the superabsorbent polymer, so as to provide a heat-absorbing mass, which enhances thermal protection at the covered region.

As shown in FIG. 4, the outer cover 210 of the knee pad 30 is affixed by stitching S, at its lower edge and two side edges, to the outer shell 112 of the pants leg 12. At the upper edge of the outer cover 210 of the knee pad 30, a gap 220 is left, which enables the moisture absorber 200 to be withdrawn from a space between the outer cover 210 of the knee pad 30 and the outer shell 112 of the pants leg 12, to be reinserted into the space therebetween, or to be replaced by a similar absorber to be inserted into the space therebetween. A non-metallic, hook-and-loop fastener 230 is provided, which comprises a hook-faced patch and a loop-faced patch, one such patch being affixed, as by stitching or adhesively, to the inner surface of the outer cover 210 of the knee pad 30 and the other patch being affixed, as by stitching or adhesively, to the outer surface of the outer shell 112 of the pants leg 12. The hook-and-loop fastener 230 is employed to fasten the outer cover 210 of the knee pad 30 releasably to the outer shell 112 of the pants leg 12, above the moisture absorber 200, across the gap 220.

FIG. 5 is intended to show, in an alternative arrangement, the outer cover 210 of the knee pad 30 is affixed by moisture-proof adhesive A, at all of its edges, to the outer shell 112 of the pants leg 12. FIG. 6 is intended to show, in another alternative arrangement, that the outer cover 210 of the knee pad 30 is affixed by stitching S, at all of its edges, to the outer shell 112 of the pants leg 12. The alternative arrangements of FIGS. 5 and 6 are useful if the superabsorbent polymer is susceptible to drying for reuse.

What is claimed is:

1. A protective pad affixable to a protective garment having a moisture barrier and having an outer shell covering the moisture barrier, the moisture barrier being impervious to moisture and the outer shell being pervious to moisture, wherein the protective pad has a moisture absorber pervious to moisture and incorporating a superabsorbent polymer and an outer cover pervious to moisture, and wherein, when the protective pad is affixed to the protective garment, (a) the moisture absorber covers a region of the outer shell of the protective garment, (b) the outer cover of the protective pad covers the moisture absorber, (c) the outer cover of the protective pad is affixed to the outer shell of the protective garment, at least partly around the moisture absorber, and (d) the outer cover of the protective pad and the outer shell of the protective garment, in the covered region, are adapted to conduct moisture into the moisture absorber, in which the superabsorbent polymer is adapted to absorb much if not all moisture conducted into the moisture absorber, wherein the moisture absorber has a fibrous matrix incorporating the superabsorbent polymer, wherein the fibrous matrix is disposed between an inner cover pervious to moisture and an outer cover pervious to moisture, and wherein the inner and outer covers, between which the fibrous matrix is disposed, are quilted so as to segregate discrete regions of the fibrous matrix incorporating the superabsorbent polymer.

2. A protective pad affixable to a protective garment having a moisture barrier and having an outer shell covering the moisture barrier, the moisture barrier being impervious to moisture and the outer shell being pervious to moisture, wherein the protective pad has a moisture absorber pervious to moisture and incorporating a superabsorbent polymer and an outer cover pervious to moisture, and wherein, when the protective pad is affixed to the protective garment, (a) the moisture absorber covers a region of the outer shell of the protective garment, (b) the outer cover of the protective pad covers the moisture absorber, (c) the outer cover of the protective pad is affixed to the outer shell of the protective garment, at least partly around the moisture absorber, and (d) the outer cover of the protective pad and the outer shell of the protective garment, in the covered region, are adapted to conduct moisture into the moisture absorber, in which the superabsorbent polymer is adapted to absorb much if not all moisture conducted into the moisture absorber, wherein the moisture absorber has a fibrous matrix incorporating particles of the superabsorbent polymer, wherein the fibrous matrix is disposed between an inner cover pervious to moisture and an outer cover pervious to moisture, and wherein the inner and outer covers, between which the fibrous matrix is disposed, are quilted so as to segregate discrete regions of the fibrous matrix incorporating the superabsorbent polymer.

3. The protective pad of claim 2 or 1 wherein the outer cover of the protective pad is affixed to the outer shell of the protective garment, at least partly around the moisture absorber.

4. The protective pad of claim 2 or 1 wherein the outer cover of the protective pad is affixed to the outer shell of the protective garment, at least partly around the moisture absorber, by stitching.

5. The protective pad of claim 2 or 1 wherein the outer cover of the protective pad is affixed to the outer shell of the protective garment, at least partly around the moisture absorber, adhesively.

6. The protective pad of claim 2 or 1 wherein the outer cover of the protective pad is affixed to the outer shell of the protective garment, at least partly around the moisture absorber, except for a gap enabling the moisture absorber to be withdrawn from a space between the outer cover of the protective pad and the outer shell of the protective garment, to be reinserted into the space therebetween, or to be replaced by a similar absorber to be inserted into the space therebetween.

7. The protective pad of claim 6 having a fastener to fasten the outer cover of the protective pad releasably to the outer shell of the protective garment, across the gap.

* * * * *

UNITED STATES PATENT AND TRADEMARK OFFICE

CERTIFICATE OF CORRECTION

PATENT NO. : 6,317,889 B1
DATED : November 20, 2001
INVENTOR(S) : Reilly et al.

It is certified that error appears in the above-identified patent and that said Letters Patent is hereby corrected as shown below:

Column 1,
Line 63, "barrier" should be replaced by -- absorber --.

Signed and Sealed this

Eleventh Day of June, 2002

*Attest:*

*Attesting Officer*

JAMES E. ROGAN
*Director of the United States Patent and Trademark Office*